US006601368B1

(12) United States Patent
Lehtonen et al.

(10) Patent No.: US 6,601,368 B1
(45) Date of Patent: Aug. 5, 2003

(54) METHOD AND ARRANGEMENT FOR FORMING A GROUP OF ROLLS

(75) Inventors: Risto Lehtonen, Hollola (FI); Esko Nieminen, Hyvinkää (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/807,241

(22) PCT Filed: Oct. 20, 1999

(86) PCT No.: PCT/FI99/00873

§ 371 (c)(1),
(2), (4) Date: Apr. 10, 2001

(87) PCT Pub. No.: WO00/23323

PCT Pub. Date: Apr. 27, 2000

(30) Foreign Application Priority Data

Oct. 20, 1998 (FI) ..... 982271

(51) Int. Cl.[7] ..... B65B 13/02; B65B 53/02; B65B 63/04

(52) U.S. Cl. ..... 53/399; 53/441; 53/430; 53/443; 53/118; 53/557

(58) Field of Search ..... 53/399, 441, 430, 53/435, 443, 448, 118, 522, 531, 557, 493

(56) References Cited

U.S. PATENT DOCUMENTS

| | | | | | |
|---|---|---|---|---|---|
| 2,050,394 | A | * | 8/1936 | Straubel | 206/389 |
| 3,857,220 | A | * | 12/1974 | Schneider et al. | 53/500 |
| 3,960,272 | A | * | 6/1976 | Hartbauer et al. | 156/184 |
| 4,679,379 | A | * | 7/1987 | Cassoli | 100/232 |
| 4,730,438 | A | * | 3/1988 | Koutonen | 53/409 |
| 4,736,567 | A | * | 4/1988 | Pienta | 156/447 |
| 4,882,892 | A | * | 11/1989 | Pienta | 53/176 |
| 4,984,411 | A | * | 1/1991 | Reist | 53/118 |
| 5,038,549 | A | * | 8/1991 | Nordstrom | 414/794.9 |
| 5,046,298 | A | * | 9/1991 | Norkoski et al. | 53/136.2 |
| 5,195,300 | A | * | 3/1993 | Kovacs et al. | 100/207 |
| 5,419,098 | A | * | 5/1995 | Meier | 53/438 |
| 5,433,063 | A | * | 7/1995 | Kovacs et al. | 53/374.5 |
| 5,575,135 | A | * | 11/1996 | Nordstrom | 53/228 |
| 5,590,507 | A | * | 1/1997 | Wyssmann | 53/399 |
| 5,765,340 | A | * | 6/1998 | Ekblom | 53/399 |
| 6,067,780 | A | * | 5/2000 | Gentili et al. | 53/230 |

FOREIGN PATENT DOCUMENTS

| | | | | |
|---|---|---|---|---|
| DE | 26 57 865 A1 | | 7/1977 | B65B/57/14 |
| DE | 196 05 783 A1 | | 8/1997 | B65B/35/12 |
| EP | 0 705 783 A1 | | 4/1996 | B65H/19/30 |
| EP | 0 705 783 | * | 10/1996 | B65H/19/30 |
| GB | 2 044 713 | * | 2/1979 | |

* cited by examiner

*Primary Examiner*—Rinaldi I. Rada
*Assistant Examiner*—Paul Durand
(74) *Attorney, Agent, or Firm*—Cohen, Pontani, Lieberman & Pavane

(57) ABSTRACT

The present invention relates to a method and apparatus for forming a group of rolls of at least two rolls of paper, board or cellulosic material web, said method comprising the steps of separating apart from each other the rolls (3, 4, 5, 6, 7) of a roll set received from said slitter-winder (1), and combining desired rolls (3, 4, 5) of the roll set into a multi-roll pack. At least one of the desired rolls (3, 4, 5) to be included in the multi-roll pack is taken apart from the other rolls (6, 7) of the roll set resting on a conveyor (8, 9) and is moved to a waiting station (10) and is then moved back from the waiting station (10) onto the conveyor (9) in a manner allowing the desired rolls (3, 4, 5) of the multi-roll pack to be sorted into a desired order having the adjacent ends of the rolls facing each other.

25 Claims, 16 Drawing Sheets

METHOD AND ARRANGEMENT FOR FORMING A GROUP OF ROLLS

This is a national stage of PCT application No. PCT/FI99/00873, filed on Oct. 20, 1999. Priority is claimed on that application, and on patent application No. 982271 filed in Finland on Oct. 20, 1998.

FIELD OF THE INVENTION

The present invention relates to a method and apparatus for forming a group of rolls from at lest two rolls of a paper, board or cellulosic material web.

BACKGROUND OF THE INVENTION

In paper mills, the rolls exiting the paper machine are slit at a slitter-winder into rolls of narrower width according to customer order. The widths of the narrowest customer rolls vary in the range of 100–500 mm. For instance, in mills making printing paper grades, the roll widths of narrow rolls are typically from 180 mm to 400 mm, in cardboard mills from 350 mm to 500 mm and in the manufacture of roll cores from 100 mm to 300 mm.

Narrow rolls are delivered to the customer either individually wrapped or, typically, as two- or multi-roll packs containing 2–4 rolls protected by a common wrapper. The ratio of the roll maximum diameter to the roll width of the separately wrapped narrow rolls is typically about 2.5, because a higher diameter-to-width ratio would cause instability in the handling and shipping of the rolls. In practice, the narrowest width of single rolls is typically about 300–400 mm and the maximum diameter depending on the paper or board grade is about 1000–1800 mm. In the delivery of two/multi-roll packs, the rolls are advantageously wrapped end-to-end together immediately after they leave the slitter-winder, because their handling and shipping in bundled form is much easier. One method of connecting the rolls to be packed together is to insert through their center bores a common inner core that holds the rolls of the pack together. Another commonly used method is to thread a reinforced plastic band through the roll center bores and about their perimeter, thus strapping the rolls into a tight pack. Damage to the edges of the outer rolls of the pack can be prevented by placing protective corner pieces under the angles of the strap. A still further method to combine rolls into a pack is to enclose the roll pack in a stretch-film wrap. Board rolls may also be bundled together using a self-adhesive tape wrap. If the rolls to be bundled are picked from separate sets of rolls, the adjacent rolls in pack may have different outer diameters, which can cause problems in the insertion of the connecting inner core as well as in the transport, wrapping and truck handling of the roll pack. Therefore, the rolls having a larger diameter are often calibrated by stripping off outer layers from the periphery of the roll prior to their bundling into multi-roll packs.

A method and apparatus for forming a group a group of rolls of paper, board or cellulosic material web. The method comprises separating apart form each other the rolls (3, 4, 5, 6, 7) of a roll set received from said slitter-winder (1), and combining desired rolls (3, 4, 5) of the roll set into a multi-roll pack. At least one of the desired rolls (3, 4, 5) to be included in the multi-roll pack is taken apart from the other rolls (6, 7) of the roll set resting on a conveyor (8, 9) and is moved to a waiting station (10) and is then moved back form the waiting station (10) onto the conveyor (9) in a manner allowing the desired rolls (3, 4, 5) of the multi-roll pack to be stored into a desired order having the adjacent ends of the rolls facing each other.

SUMMARY OF THE INVENTION

It is an object of the present invention to provide a method and an arrangement suited for handling rolls to be packaged into two- or multi-roll packs by automatically picking desired rolls apart from other rolls of a set, sorting the desired rolls into a desired order and placing said rolls abutting end-to-end each other prior to their bundling into a multi-roll pack.

In an embodiment according to the invention, the rolls leaving the slitter-winder are first separated from each other, e.g., by means of stop gages on the downward ramp following the slitter-winder or, alternatively, at the cross-over point of two conveyors located after the slitter-winder, whereupon at least some of the narrow rolls to be bundled into two- or multi-roll packs are taken apart from the other rolls of the sequence of rolls transported by the conveyor system and directed to a waiting station which is located alongside the conveyor and from which the rolls are transferred at a desired instant back onto the conveyor. Another function of the waiting station is to serve in the sorting of the rolls into a desired order. Next, the rolls can be combined into a pack, e.g., in a separate grouping station. From the grouping station, the bundled pack of rolls continues its travel in the packaging system.

The invention offers significant benefits.

By virtue of the invention, the tedious and time-consuming task of manual handling of rolls to be bundled into a two- or multi-roll pack can be eased substantially. Simultaneously, the capacity of the roll handling system is increased and risky situations in mill operation are reduced. Furthermore, the entrance to the slitter-winder can be protected by a fence, for instance, inasmuch as human attendance within the slitter-winder area becomes unnecessary under normal conditions.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
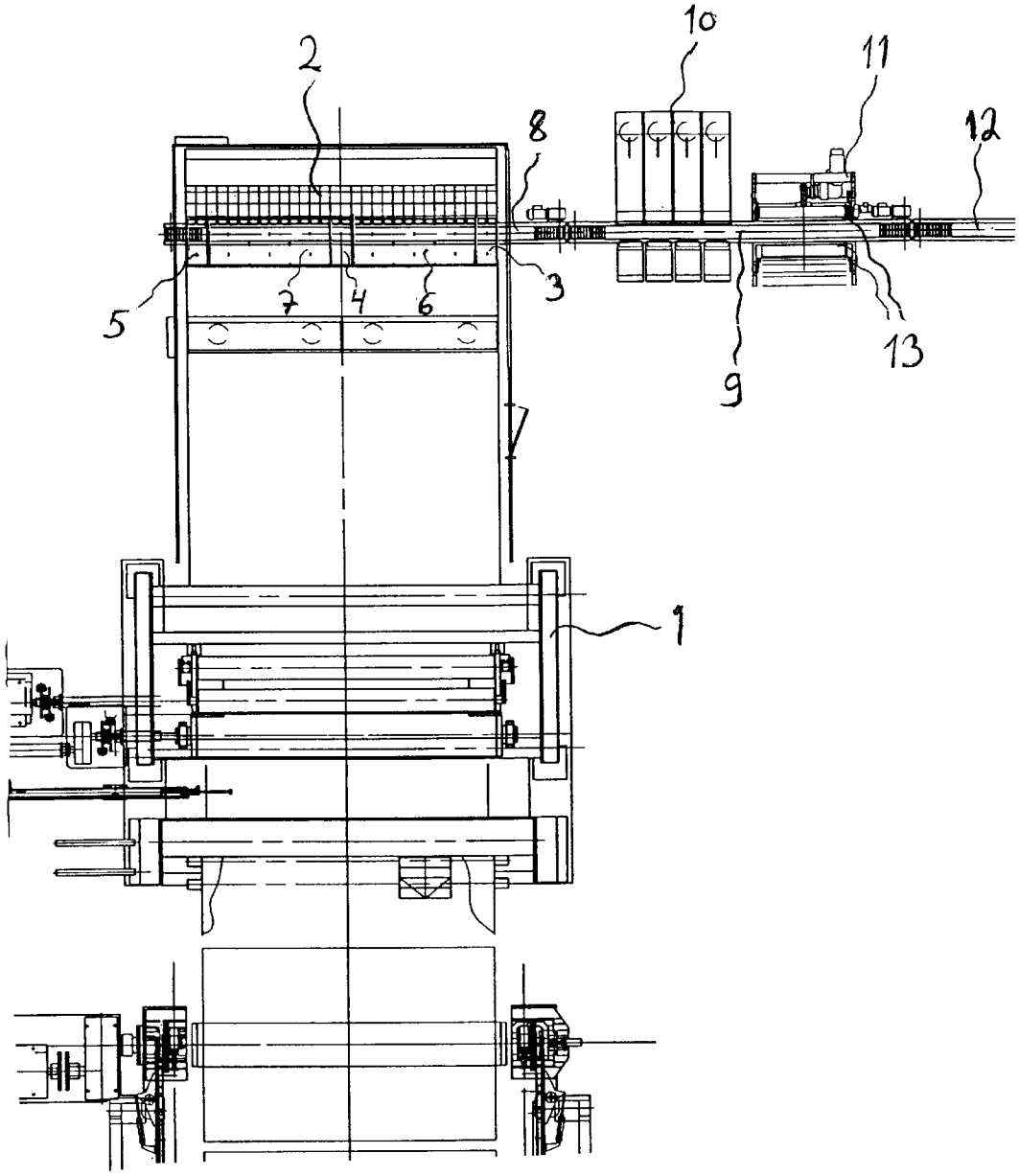
FIGS. 1–15 show an embodiment according to the invention in its different operating phases.

Referring to FIG. 1, therein a set of rolls coming from a slitter-winder 1 is shown being received at a roll set stop 2. The roll set comprises narrow rolls 3, 4, 5 to be packaged into a multi-roll pack and wide rolls 6, 7 to be packaged individually. The narrow rolls 3, 4, 5 are situated at the center and both ends of the roll set.

Figure 2:
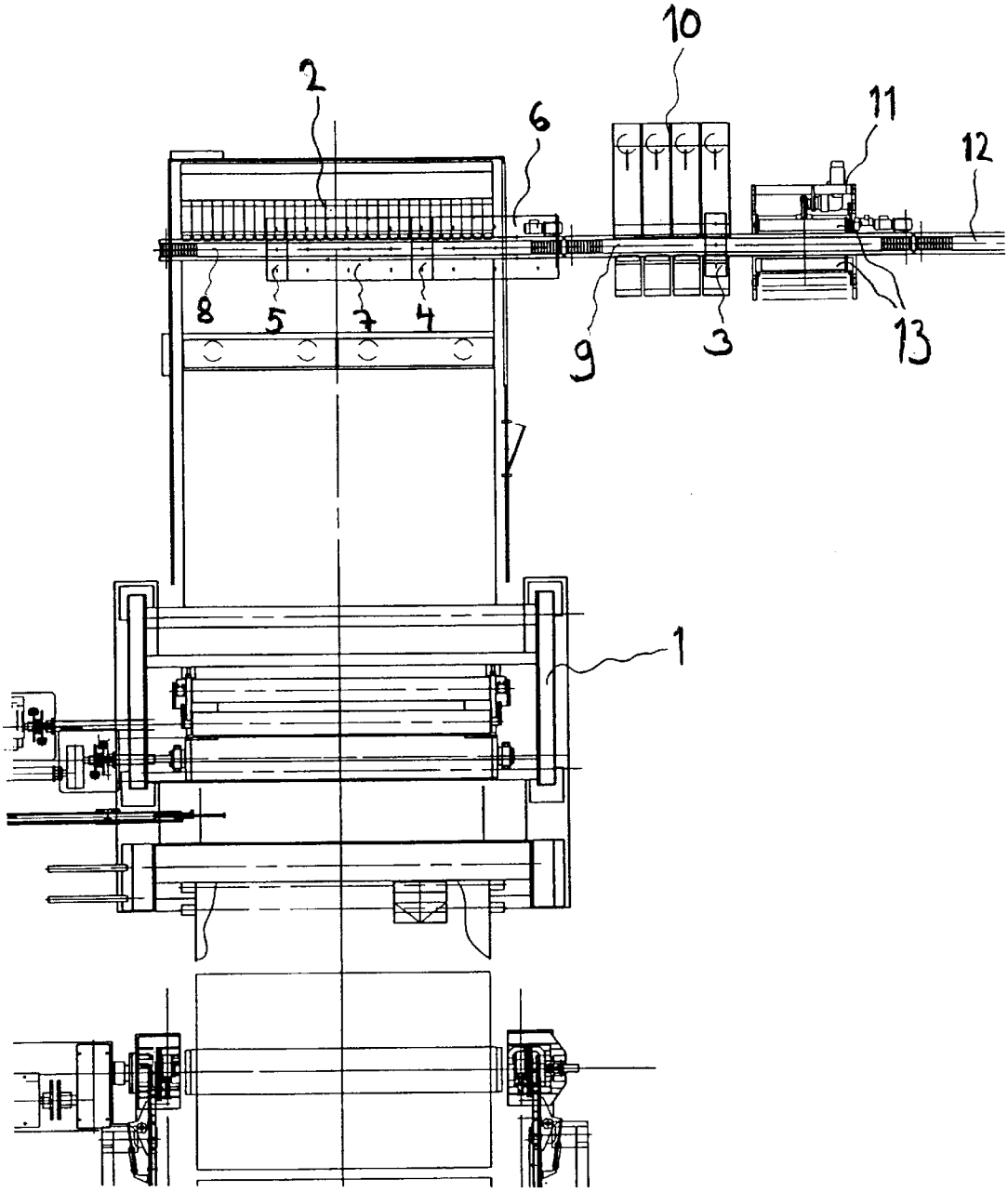

In FIG. 2 is shown the first narrow roll 3, which is to be included in a multi-roll pack, being taken apart from said set of rolls traveling at the cross-over point of conveyors 8, 9 by means of stopping the conveyor 8 when the desired roll 3 reaches the cross-over point, whereby the roll 3 continues its travel on the conveyor 9 while the other rolls 4, 5, 6, 7 of the set remain resting on the conveyor 8.

Figure 3:
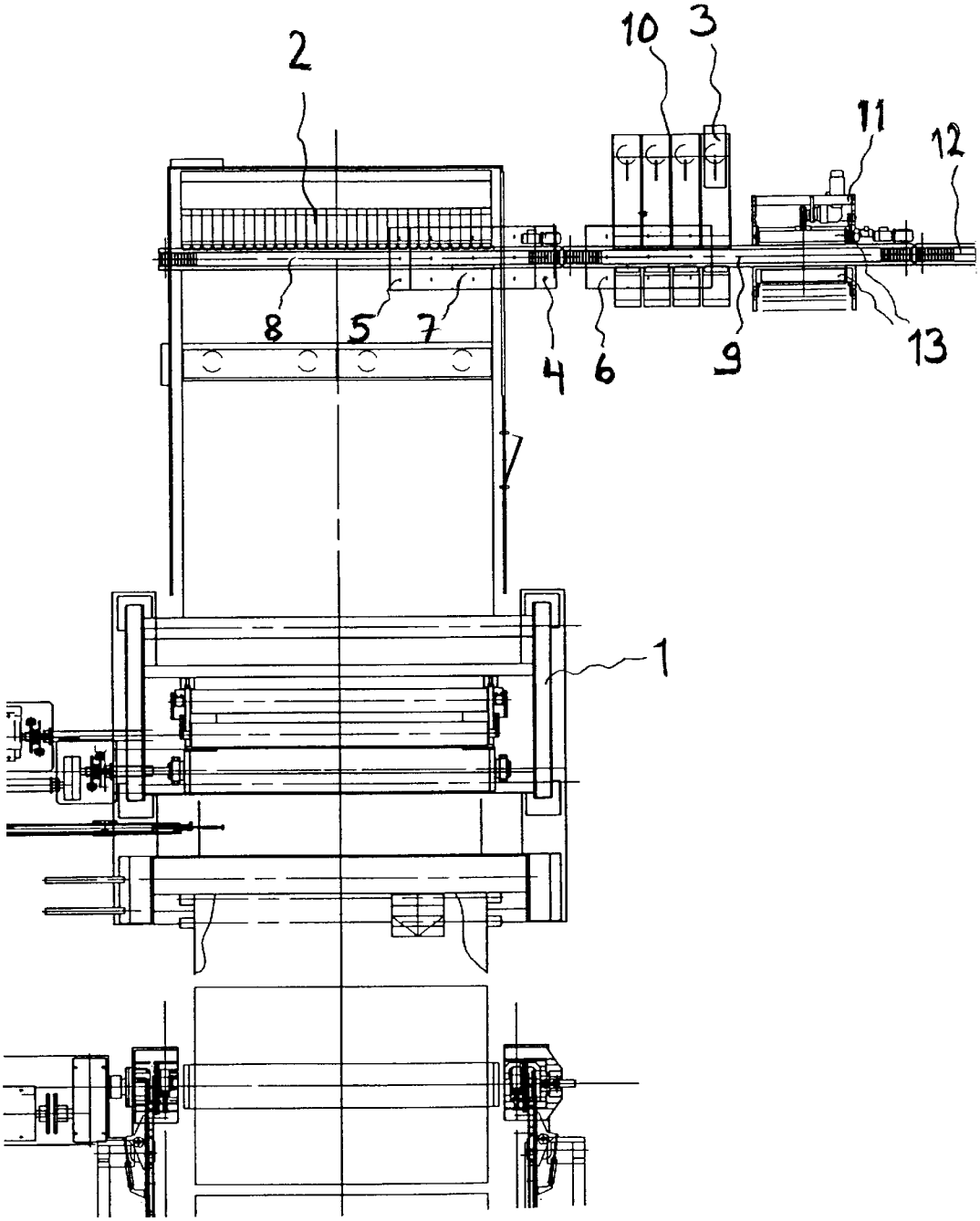

In FIG. 3 the roll 3 is shown being moved from the conveyor 9 onto the cradle of a waiting station 10, e.g., by means of a pusher located alongside the conveyor 9. Simultaneously, the conveyor 8 is started, whereby the wide roll 6 is taken apart from the rolls 4, 5, 7 at the cross-over point of the conveyors 8, 9. Next, the conveyor 8 is stopped, whereby the roll 6 proceeds to travel on the conveyor 9.

Figure 4:
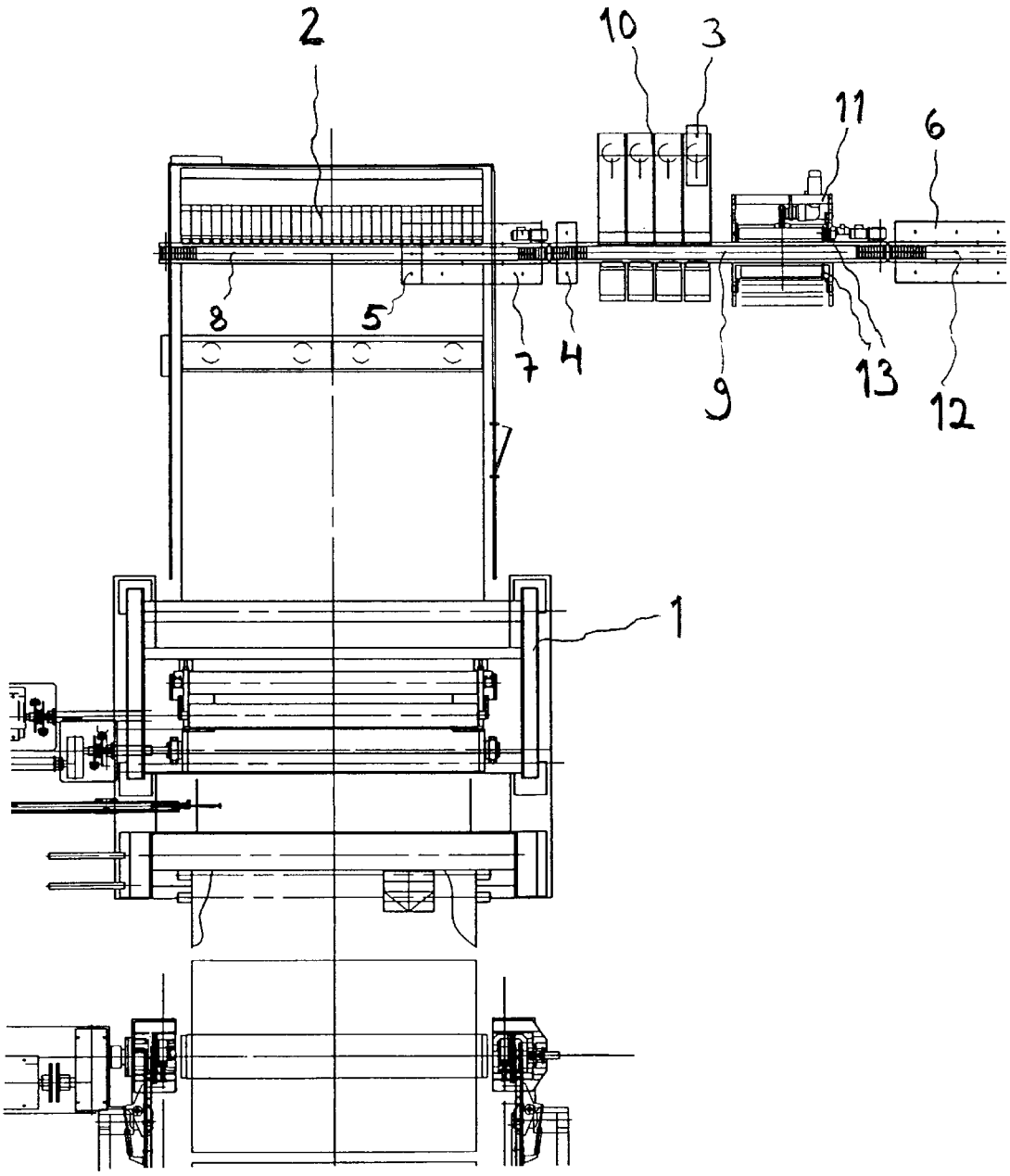

In FIG. 4 the second narrow roll 4 to be included in the pack is shown being taken apart from the other rolls 5, 7 resting on the conveyor 8 at the cross-over point of the. conveyors 8, 9 in the above-described manner. The wide roll 6 is transferred past the waiting station 10 and the grouping station 11 of the system to a conveyor 12.

Figure 5:
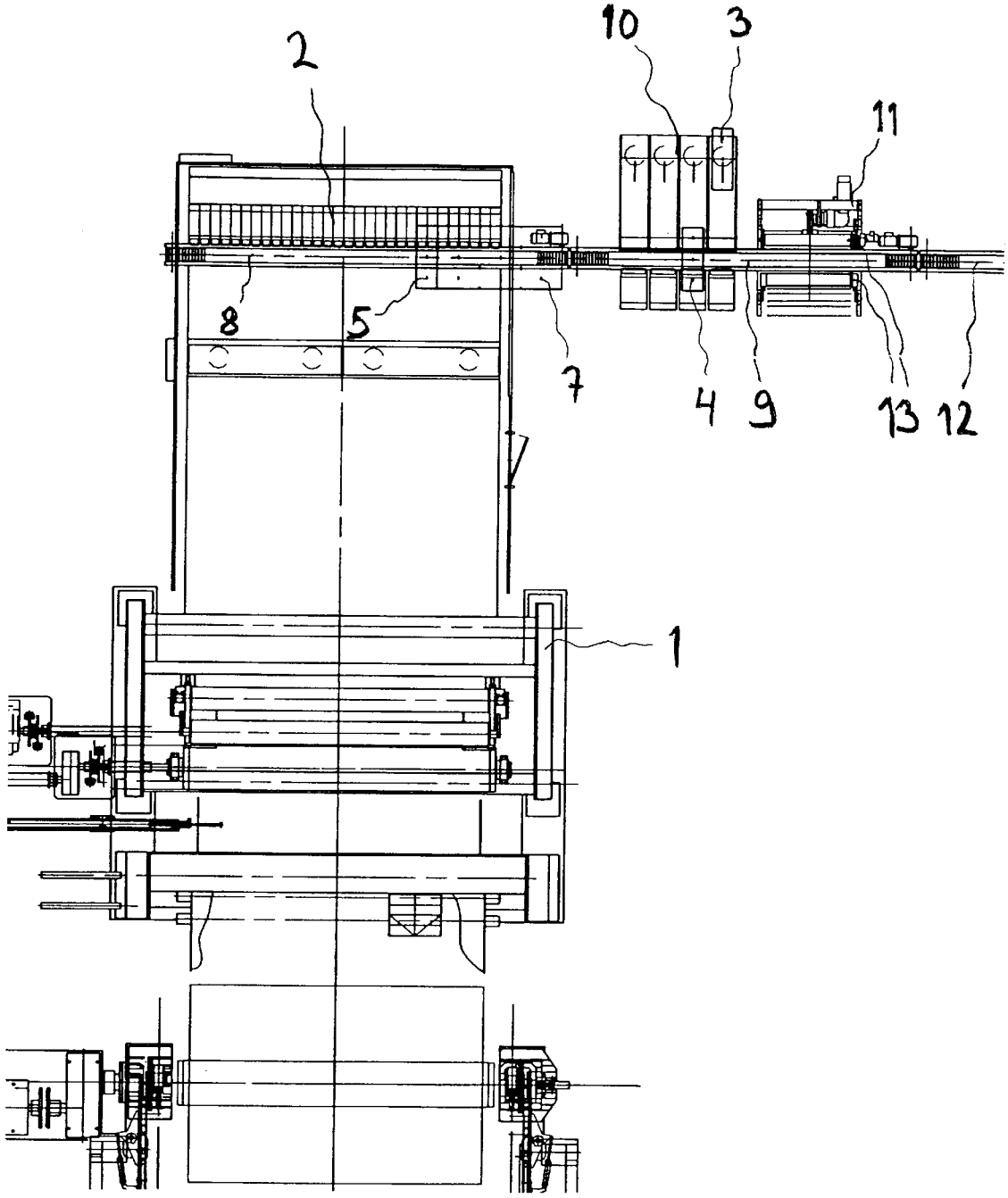

In FIG. 5 the roll 4 is shown being moved into a position facing the second cradle of the waiting station 10.

Figure 6:
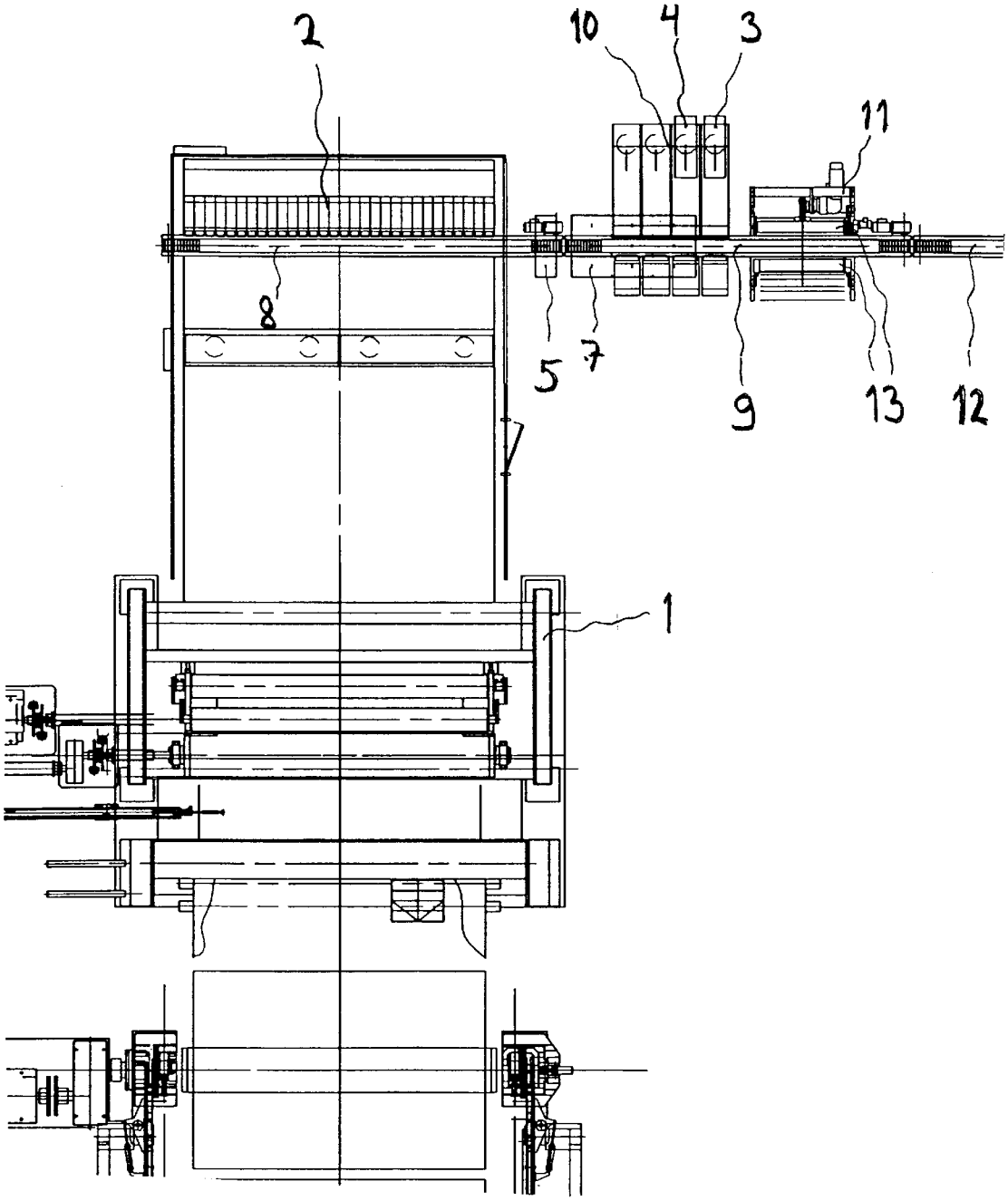

In FIG. 6 the roll 4 is shown being pushed onto the cradle of the waiting station 10 and a second wide roll 7 is taken apart from the roll 5. The roll 7 continues its travel on the conveyor 9, while the roll 5 remains waiting at the cross-over point of the conveyors 8, 9.

Figure 7:
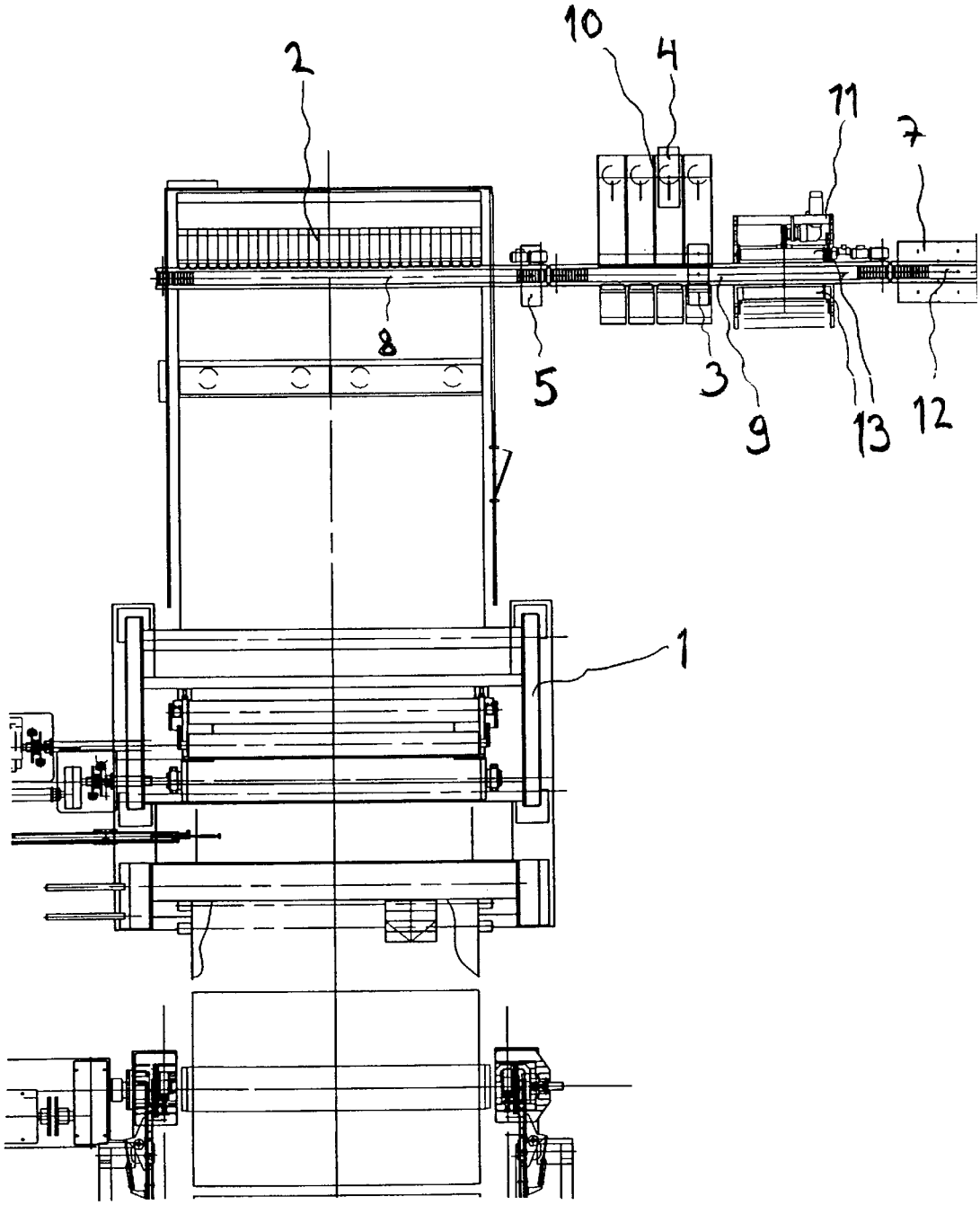

In FIG. 7 the wide roll 7 is shown being transferred past the waiting station 10 and the grouping station 11 to the conveyor 12. The roll 3 is transferred back onto the conveyor 9 from the cradle of the waiting station 10.

Figure 8:
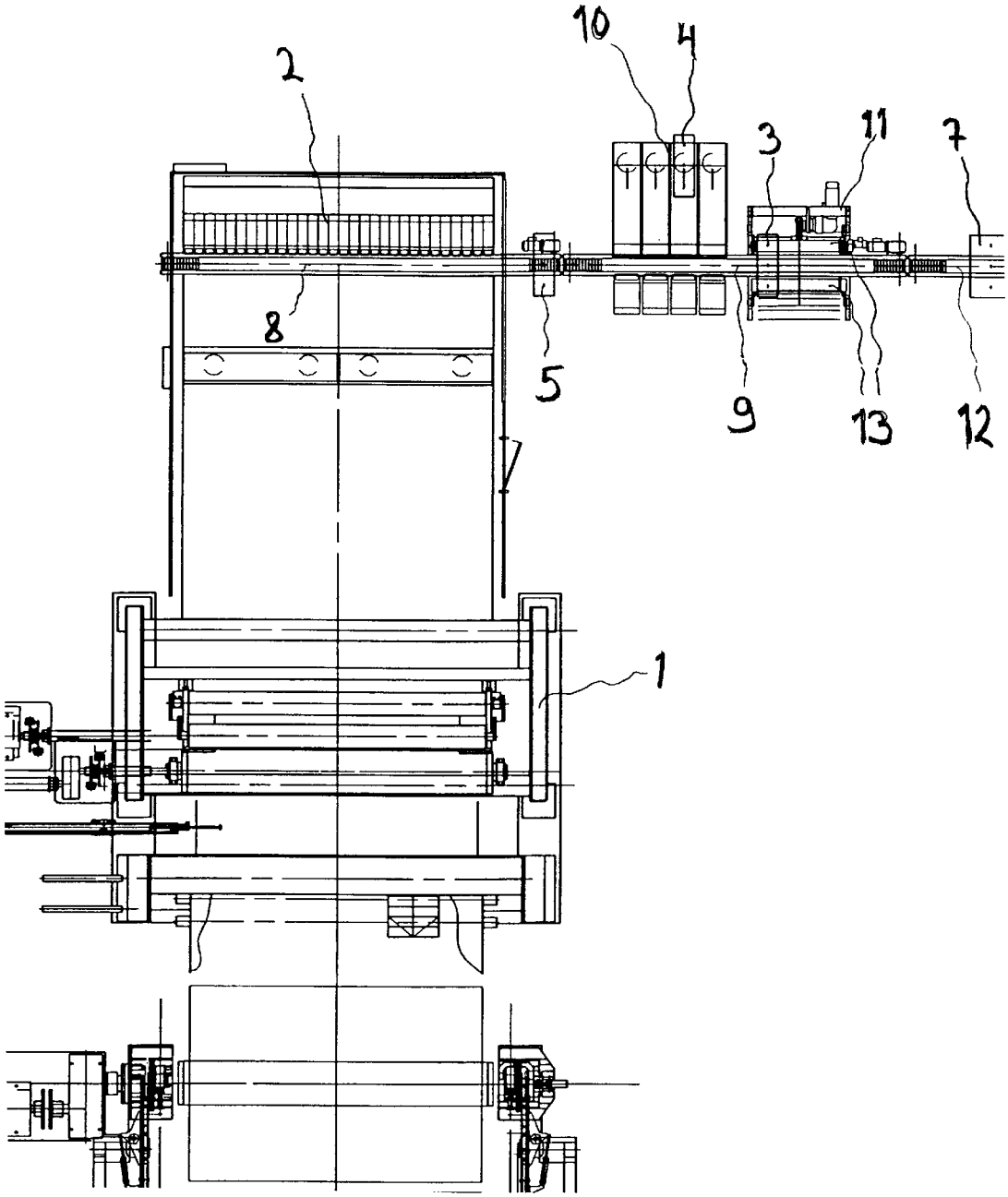

In FIG. 8 the roll 3, which has been transferred from the waiting station 10 back onto the conveyor 9, is shown being transferred on the conveyor 9 onto support rolls 13 of the grouping station 11.

Figure 9:
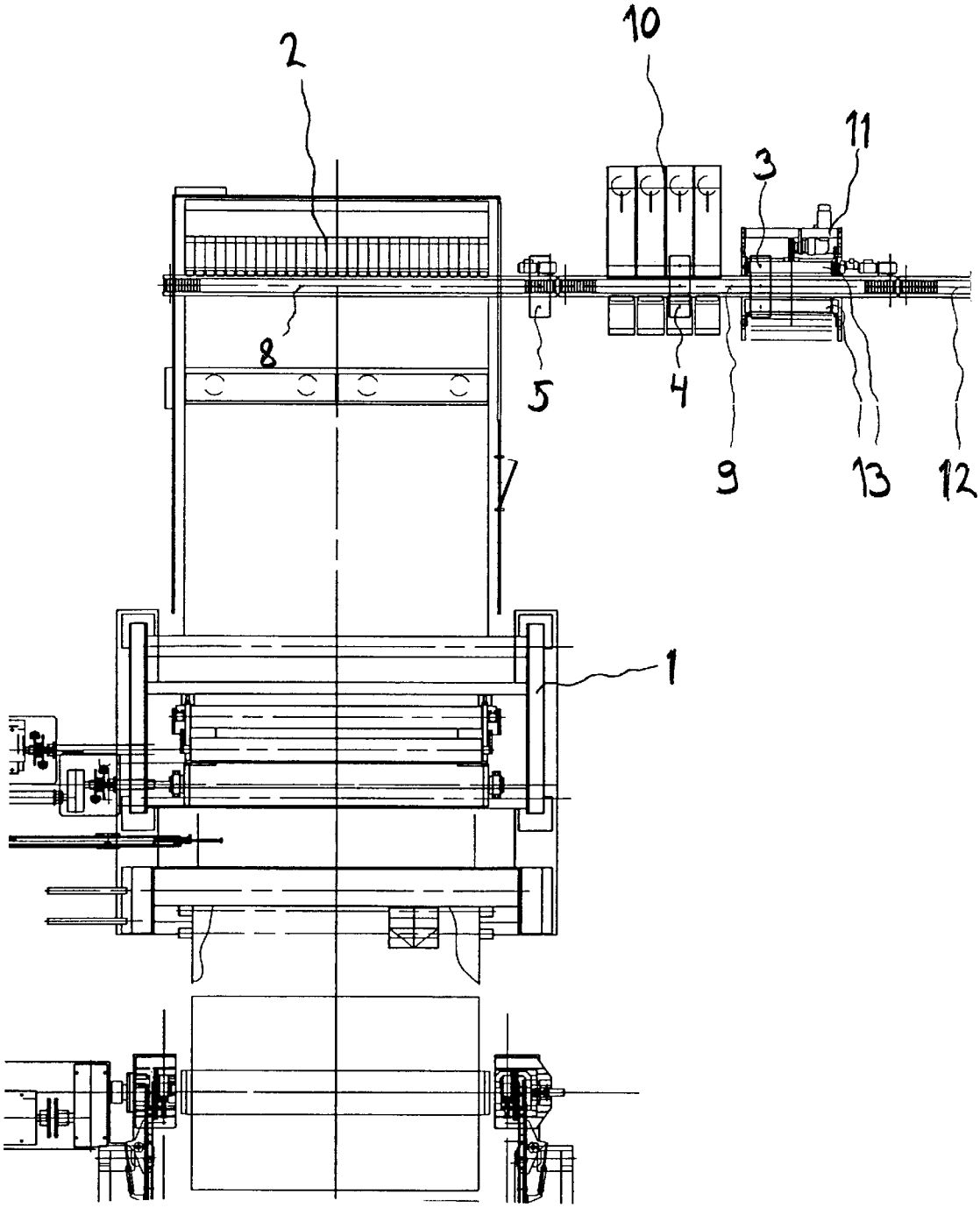

In FIG. 9 the roll 3 is shown being elevated by means of the support rolls 13 of the grouping station 11 up from the conveyor 9 and, simultaneously, the roll 4 is transferred from the waiting station 10 back onto the conveyor 9.

Figure 10:
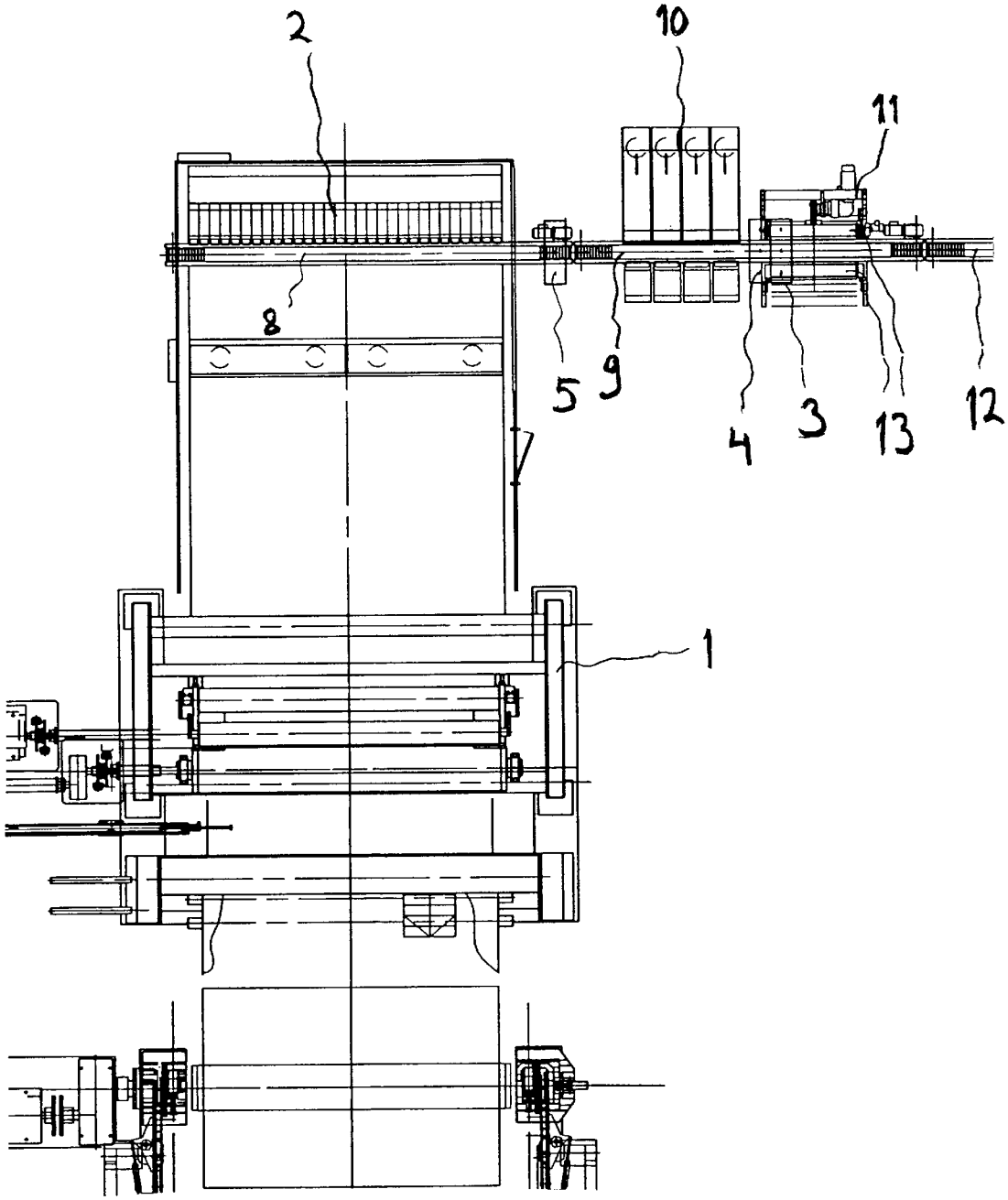

In FIG. 10 the roll 4 is shown being transferred by means of the conveyor 9 into a position facing the roll 3 resting on the support rolls 13 of the grouping station 11.

Figure 11:
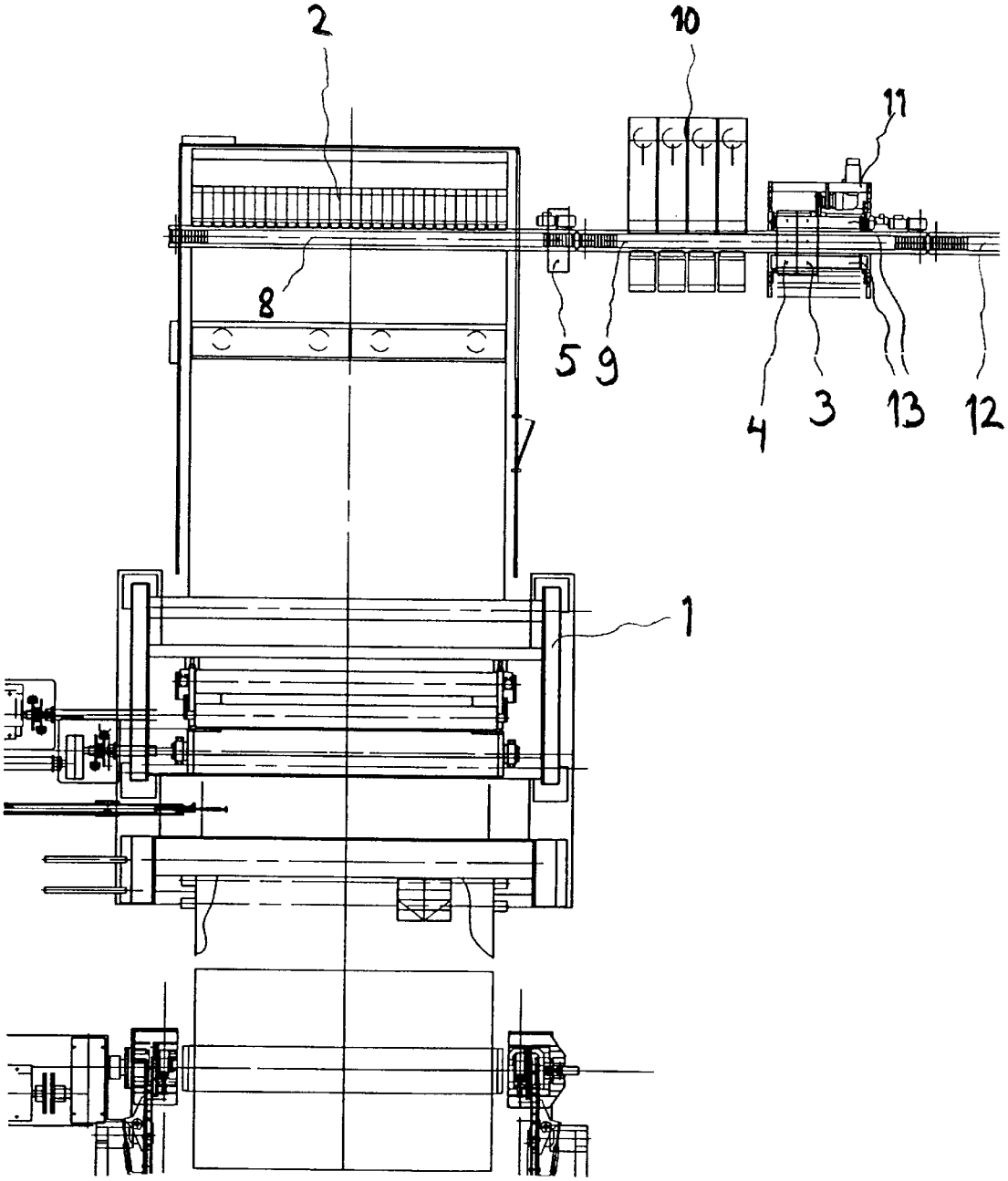

In FIG. 11 the support rolls 13 of the grouping station 11 are shown being lowered down and the roll 4 being moved onto the support rolls 13, whereupon rolls 3, 4 are elevated by means of the support rolls 13 up from the conveyor 9.

Figure 12:
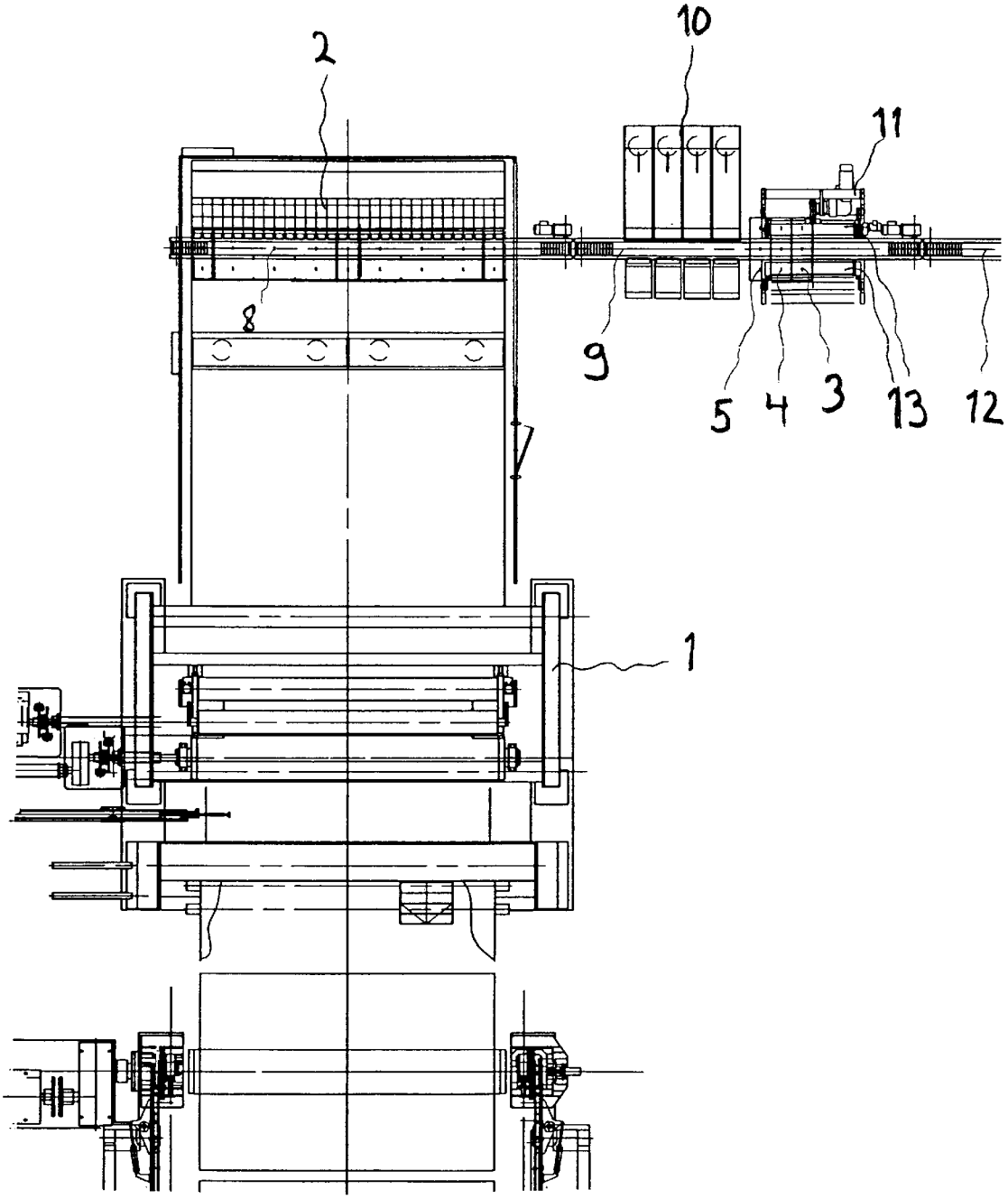

In FIG. 12 a third narrow roll 5 is shown being transferred by means of the conveyor 9 into a position facing the roll 4 resting on the support rolls 13 of the grouping station 11. Simultaneously, a new set of rolls leaving the slitter-winder 1 is stopped by means of a roll set stop gauge 2.

Figure 13:
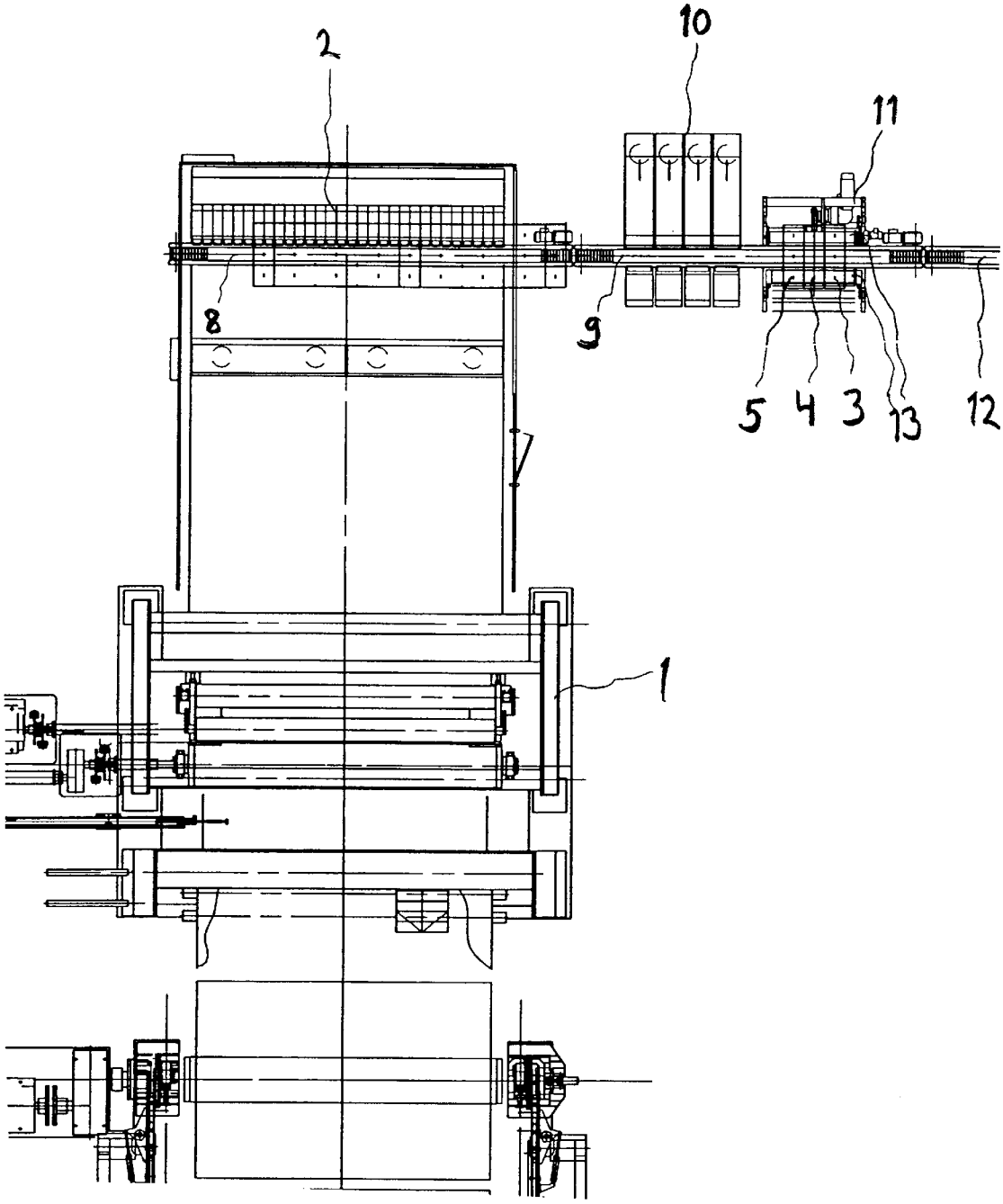

In FIG. 13 the support rolls 13 of the grouping station 11 are shown being lowered down, whereby the roll 5 is moved to rest on the support rolls 13. Next, the support rolls 13 are lifted up and the rolls 3, 4, 5 are packaged into a multi-roll pack.

Figure 14:
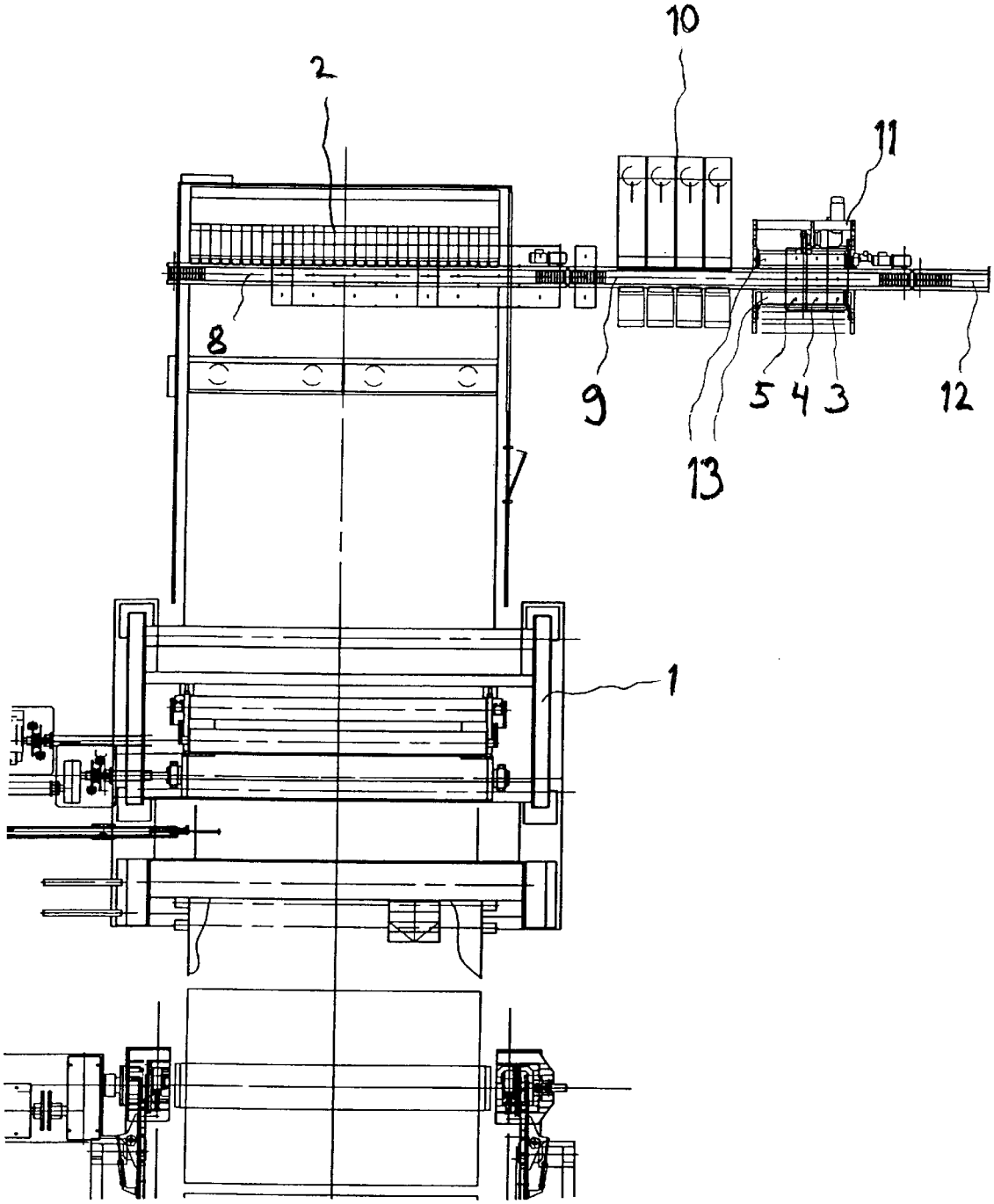

In FIG. 14 the support rolls 13 of the grouping station 11 are shown being lowered down and a first narrow roll of a new roll set to be included in a new multi-roll pack is taken apart from the other rolls of the new set at the cross-over point of the conveyors 8, 9.

Figure 15:
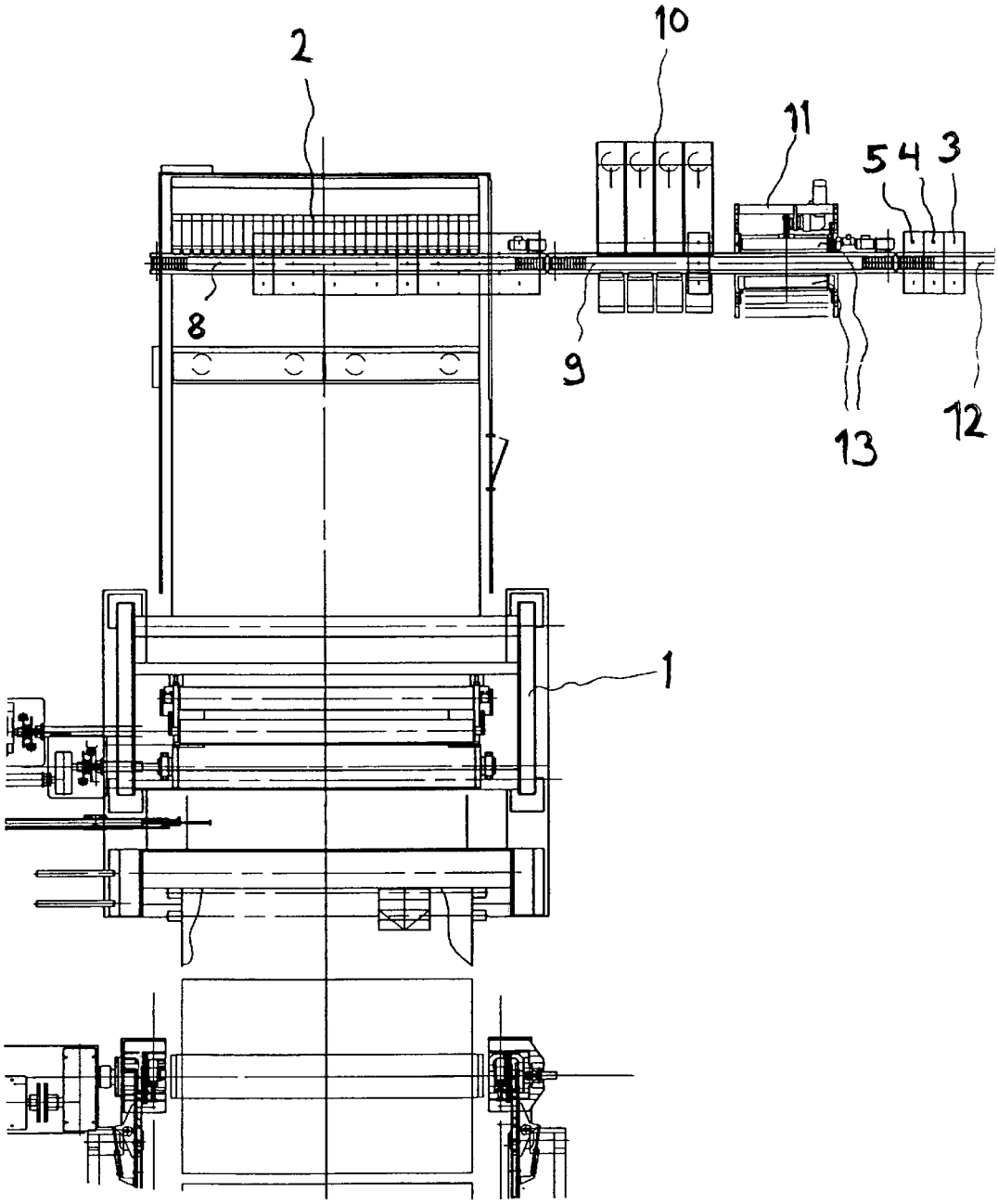

In FIG. 15 the multi-roll pack formed by the rolls 3, 4, 5 is shown continuing its travel in the system on the conveyor 12 and the first narrow roll of the new roll set is shown being transferred by means of the conveyor 9 to the waiting station 10.

Figure 16:
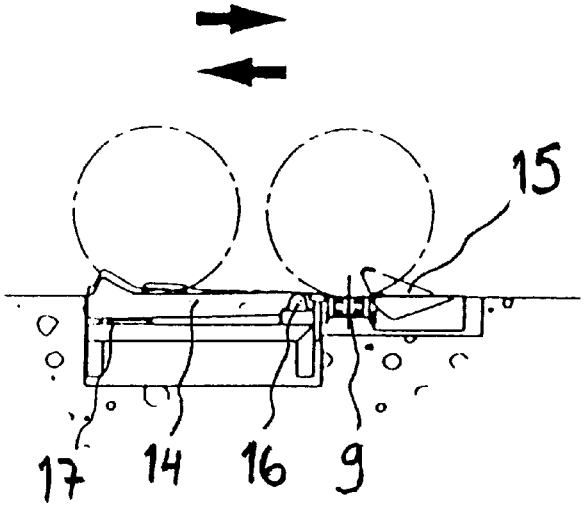
FIG. 16 shows a side view of the waiting station cradle of an embodiment of the arrangement according to the invention.

The cradle of the waiting station 10 shown in FIG. 16 may be formed, e.g., as a V-shaped plane 14 which is hingedly mounted by its end closest to the conveyor 9, whereby the roll can be moved onto the cradle with the help of a pusher 15 located alongside the conveyor 9. The roll can be moved back onto the conveyor 9 from the cradle by tilting the cradle with the help of an elevating actuator 17 adapted to the opposite end of the cradle in respect to the cradle hinge 16.

In addition to those described above, the invention may have alternative embodiments.

The rolls to be combined into a multi-roll pack at the grouping station 11 may obviously be picked from any desired point of a roll set or different sets of rolls. It is also possible to separate the rolls of a set from each other by means of stop flaps which are located on the exit ramp of the slitter-winder 1, in front of the roll set stop gauge 2. In this arrangement, the first conveyor 8 next to the stop gauge 2 can be made longer because the rolls need not anymore be separated from each other at the cross-over point of the two conveyors 8, 9. The location, number and width of the cradles of the waiting station 10 can be selected relatively freely. The cradles can be located on either side of the conveyor 9 or, alternatively, on both sides of the conveyor 9. Instead of the support rolls 13, grouping station 11 can be provided with an idle roller set located between the two conveyors. When necessary, the rolls 3, 4, 5 may also be calibrated by stripping off their outer layers to reach equal roll diameter prior to their packaging. Furthermore, the rolls 3, 4, 5 may also be brought into a multi-roll pack by stopping the conveyor 9 so that the roll being picked can be moved from the waiting station 10 on to the conveyor 9 into a position immediately facing either end of another roll resting on the conveyor 9. After the rolls 3, 4, 5 to be included in a multi-roll pack have thus been sorted into a desired order on the conveyor 9, the rolls 3, 4, 5 can be bundled into a pack. The rolls 3, 4, 5, to be bundled may also be first moved onto adjacent cradles of the waiting station 10, after which the rolls 3, 4, 5 are moved from the cradles back onto the conveyor 9 and subsequently bundled into a pack. In both arrangements, the rolls 3, 4, 5 can be combined into multi-roll packs on the conveyor 9, thus obviating the need for a separate grouping station 11. Besides paper web rolls, also board and cellulosic web rolls can be handled by virtue of the invention. onto the conveyor 9 and subsequently bundled into a pack. In both arrangements, the rolls 3, 4, 5 can be combined into multi-roll packs on the conveyor 9, thus obviating the need for a separate grouping station 11. Besides paper web rolls, also board and cellulosic web rolls can be handled by virtue of the invention.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. Method for forming a group of rolls from at least two rolls of a paper, board or cellulosic material web, comprising:

providing a packaging system with information concerning roll sets leaving a slitter-winder;

separating apart from one another the rolls of a roll set received from the slitter-winder;

transporting the separated rolls on a conveyor in an axial direction of the separated rolls;

removing at least one of the separated rolls of the roll set from the conveyor and moving the at least one removed roll to a waiting station, the waiting station comprising a plurality of cradles adjacent to one another along a roll transportation direction of the conveyor, each cradle being suitable for retaining a removed roll out of contact of rolls transported on the conveyor, each cradle retaining a removed roll in an orientation such that an axis of the removed roll is parallel to the roll transportation direction on the conveyor; and combining at least two rolls into a multi-roll pack in a desired order, at least one of the rolls combined into the multi-roll pack being taken from the at least one roll removed to the waiting station, wherein in the multi-roll pack adjacent ends of rolls face one another.

2. The method of claim 1, wherein the at least one roll is taken from the waiting station to be combined into the multi-roll pack by a conveyor which moves the at least one roll at the appropriate time so as to place the at least one roll in the desired order in the multi-roll pack.

3. The method of claim 1, wherein the at least two rolls are combined into the multi-roll pack at a grouping station.

4. The method of claim 3, further comprising:

moving a desired roll of the roll set by means of a conveyor to an end of group of other rolls resting on support rolls of the grouping station so that adjacent ends of rolls face one another; and bundling the desired roll and the other rolls into a multi-roll pack at the grouping station.

5. The method of claim 4, wherein combining the rolls into a multi-roll pack comprises inserting a common inner core through inner bores of the rolls.

6. The method of claim 4, wherein combining the rolls into a multi-roll pack comprises strapping the rolls with a reinforced plastic band.

7. The method of claim 4, wherein combining the rolls into a multi-roll pack comprises strapping the rolls with a self-adhesive tape.

8. The method of claim 4, wherein combining the rolls into a multi-roll pack comprises strapping the rolls with a stretch-film wrap.

9. The method of claim 2, wherein combining the rolls into a multi-roll pack comprises inserting a common inner core through inner bores of the rolls.

10. The method of claim 3, wherein combining the rolls into a multi-roll pack comprises strapping the rolls with a reinforced plastic band.

11. The method of claim 3, wherein combining the rolls into a multi-roll pack comprises strapping the rolls with a self-adhesive tape.

12. The method of claim 3, wherein combining the rolls into a multi-roll pack comprises strapping the rolls with a stretch-film wrap.

13. The method of claim 1, wherein the rolls of a roll set are separated apart from one another at a point between the conveyor and another conveyor.

14. The method of claim 13, wherein separation of rolls of a roll set comprises stopping movement of the rolls proximate the point between the two conveyors so that a roll to be separated from the roll set is on a first of the two conveyors and a remainder of the roll set is on a second of the two conveyors, thereby allowing the roll on the first of the two conveyors to continue travel on the first of the two conveyors.

15. The method of claim 1, wherein the rolls of a roll set are separated apart from one another by means of stop flaps located on an exit ramp of the slitter-winder in front of a roll set stop gauge.

16. The method of claim 1, wherein the rolls that are combined into a multi-roll pack originate from more than one roll set.

17. The method of claim 1, wherein combining the rolls into a multi-roll pack comprises inserting a common inner core through inner bores of the rolls.

18. The method of claim 1, wherein combining the rolls into a multi-roll pack comprises strapping the rolls with a reinforced plastic band.

19. The method of claim 1, wherein combining the rolls into a multi-roll pack comprises strapping the rolls with a self-adhesive tape.

20. The method of claim 1, wherein combining the rolls into a multi-roll pack comprises strapping the rolls with a stretch-film wrap.

21. The method of claim 1, wherein at least one of the rolls is calibrated to a desired diameter prior to the combining of the rolls into a multi-roll pack.

22. An apparatus for forming a group of rolls from at least two rolls of a paper, board or cellulosic material web, comprising:

at least one conveyor positioned proximate a slitter-winder positioned to receive rolls leaving the slitter-winder, the at least one conveyor being capable of transporting the rolls in an axial direction of the rolls; and at least one waiting station positioned proximate one of said at least one conveyor so as to be capable of removing at least one roll from said one of said at least one conveyor to the at least one waiting station, the at least one waiting station comprising a plurality of cradles adjacent to one another along a roll transportation direction of the at least one conveyor, each cradle being suitable for retaining a removed roll out of contact of rolls transported on the at least one conveyor, each cradle retaining a removed roll in an orientation such that an axis of the removed roll is parallel to the roll transportation direction on the conveyor, the at least one waiting station being capable of transferring at least one roll from said waiting station to one of said at least one conveyor, said at least one conveyor and said at least one waiting station being operative to sort a plurality of rolls received from the slitter-winder by said at least one conveyor so as to be combined in a desired order into a multi-roll pack, wherein in the multi-roll pack adjacent ends of rolls face one another.

23. The apparatus of claim 22, further comprising at least one grouping station positioned proximate said at least one conveyor and said at least one waiting station, and downstream of said at least one waiting station so as to receive rolls from said at least one conveyor.

24. The apparatus of claim 23, wherein said at least one grouping station comprises support rolls capable of performing an upright elevating movement.

25. The apparatus of claim 23, wherein said at least one grouping station comprises an idle roller set.

* * * * *